United States Patent [19]

Demoures et al.

[11] 4,412,927

[45] * Nov. 1, 1983

[54] PROCESS FOR THE PREPARATION OF SUPERALKALINIZED METALLIC DETERGENT-DISPERSANTS FOR LUBRICATING OILS AND PRODUCTS OBTAINED THEREFROM

[75] Inventors: Bernard Demoures, Puteaux; Jean-Louis Le Coent, Le Havre, both of France

[73] Assignee: Orogil Corporation, Courbevoie, France

[ * ] Notice: The portion of the term of this patent subsequent to Oct. 6, 1998, has been disclaimed.

[21] Appl. No.: 350,282

[22] Filed: Feb. 19, 1982

Related U.S. Application Data

[63] Continuation of Ser. No. 49,958, Jun. 19, 1979, abandoned.

[30] Foreign Application Priority Data

Jun. 26, 1978 [FR] France ..... 78 18947

[51] Int. Cl.[3] ..... C10M 1/40

[52] U.S. Cl. ..... 252/33.3; 252/42.7

[58] Field of Search ..... 252/33.3, 42.7

[56] References Cited

U.S. PATENT DOCUMENTS

| | | | |
|---|---|---|---|
| 2,680,096 | 6/1954 | Walker et al. | 252/42.7 |
| 3,036,971 | 5/1962 | Otto | 252/42.7 |
| 3,178,368 | 4/1965 | Hanneman | 252/42.7 |
| 3,336,224 | 8/1967 | Allphin, Jr. | 252/42.7 |
| 3,493,516 | 2/1970 | Allphin, Jr. et al. | 252/42.7 |
| 4,049,560 | 9/1977 | Dominey | 252/33.3 |

*Primary Examiner*—Charles F. Warren
*Assistant Examiner*—Y. Harris-Smith

[57] ABSTRACT

A process is provided for preparing detergent-dispersant compositions of high alkalinity by:

1. Carbonation, at a temperature of between about 100° C. and 250° C., with carbon dioxide of a reaction medium comprising a sulfurized alkylphenate of an alkaline-earth metal having a TBN of between about 1 and 170, an alkaline-earth metal alkylbenzene sulfonate having a molecular weight of more than about 300 and a TBN of less than or equal to about 150, an alkaline-earth metal compound, an alkylene glycol, and a dilution oil;
2. Removal of the alkylene glycol; and
3. Separation of the superalkalinized metallic detergent-dispersant thus obtained.

The metallic detergent-dispersant compositions obtained are useful in improving the detergent-dispersant power of lubricating oils.

20 Claims, No Drawings

PROCESS FOR THE PREPARATION OF SUPERALKALINIZED METALLIC DETERGENT-DISPERSANTS FOR LUBRICATING OILS AND PRODUCTS OBTAINED THEREFROM

This is a continuation of application Ser. No. 49,958, now abandoned, filed June 19, 1979.

BACKGROUND OF THE INVENTION

The present invention is directed to a process for preparing superalkalinized metallic detergent-dispersant compositions, useful as additives for lubricating oils, the additives per se, and to lubricating oils containing them.

British Pat. No. 1,015,769 discloses the preparation of detergent-dispersant compositions of high alkalinity having a base of alkylphenates and alkylbenzene sulfonates of alkaline earth metals by sulfurization of a mixture containing an alkylphenol, an alkaline-earth metal alkylbenzene sulfonate, a $C_8$–$C_{18}$ monoalcohol, an alkaline-earth base and glycol, precarbonation of the sulfurized mixture, alkalinization of the precarbonated mixture by an alkaline-earth base, carbonation, and then elimination of the glycol and recovery of the detergent-dispersant.

Such a process has the drawback that it requires the use of a $C_8$–$C_{18}$ monoalcohol, which must then be recycled in practically anhydrous form.

Furthermore, while such a process is satisfactory for the preparation of detergent-dispersant compositions containing a high proportion of alkylphenates, it cannot, however, be used for the preparation of detergent-dispersant compositions containing a high proportion of alkylbenzene sulfonates.

By the present invention, a process has been provided which makes it possible to prepare detergent-dispersant additives having a base of metallic alkylbenzene sulfonates and alkylphenates of a TBN (Total Basic Number-ASTM Standard D 2896) of more than about 200 in a simple and rapid manner, in the presence of alkylene glycol in only small quantity and in the absence of monoalcohol. The new process does not have the drawbacks of the prior art.

It is, therefore, an object of the present invention to provide novel detergent-dispersant compositions useful as additives for lubricating oils having a base of alkylbenzene sulfonates and sulfurized alkylphenates.

It is also an object of the present invention to provide a novel process for the preparation of detergent-dispersant compositions for use as additives in lubricating oils.

It is also an object of the present invention to provide lubricating oils containing the novel additives of the invention.

Other objects of the present invention will be apparent to those skilled in the art from the present description.

GENERAL DESCRIPTION OF THE INVENTION

The novel process of preparing the novel detergent-dispersants of the invention employs sulfurized alkylphenates, alkaline-earth metal alkylbenzene sulfonates, alkylene glycols, and carbon dioxide in the following manner:

1. carbonating, with carbon dioxide, at a temperature between about 100° C. and 250° C., a reaction medium comprising a sulfurized alkylphenate of an alkaline-earth metal of a TBN of between about 0 and 170, the said alkylphenate bearing one or more $C_6$–$C_{60}$ alkyl substituents, an alkaline earth metal alkylbenzene sulfonate of a molecular weight of more than about 300 and a TBN of less than or equal to about 150, an alkaline earth metal compound, an alkylene glycol, and a dilution oil, whereby the reagents are employed in the following quantities:

(a) from about 5 to 60 parts by weight of sulfurized alkylphenate for 100 parts by weight of mixture of sulfurized alkylphenate and alkylbenzene sulfonate;

(b) from about 95 to 40 parts by weight of alkylbenzene sulfonate for 100 parts by weight of mixture of sulfurized alkylphenate and alkylbenzene sulfonate;

(c) from about 3 to 30 parts by weight of alkaline earth compound for 100 parts by weight of mixture of sulfurized alkylphenate and alkylbenzene sulfonate;

(d) from about 4 to 60 parts by weight of alkylene glycol for 100 parts by weight of mixture of sulfurized alkylphenate and alkylbenzene sulfonate;

(e) the amount of carbon dioxide necessary for the carbonation being between that which can be completely absorbed by the reaction medium and an excess of 30 percent of said quantity;

2. removing the alkylene glycol; and 3. separating the superalkalinized metallic detergent-dispersant thus obtained.

In accordance with said process, the carbonation can be carried out one or more times, by introducing the above-defined necessary amount of alkaline-earth compound and of alkylene glycol one or more times, each introduction of alkaline-earth metal compound and of alkylene glycol being followed by a carbonation operation.

For the preferred practice of the process of the invention, the carbonation operation can be carried out at a temperature of between about 100° C. and 185° C., in the presence of a reaction medium comprising:

(a) from about 8 to 55 parts by weight of sulfurized alkylphenate for 100 parts by weight of mixture of sulfurized alkylphenate plus alkylbenzene sulfonate;

(b) from about 45 to 92 parts by weight of alkylbenzene sulfonate for 100 parts by weight of mixture of sulfurized alkylphenate plus alkylbenzene sulfonate;

(c) from about 4 to 25 parts by weight of alkaline-earth compound for 100 parts by weight of mixture of sulfurized alkylphenate plus alkylbenzene sulfonate;

(d) from about 5 to 40 parts by weight of alkylene glycol for 100 parts by weight of mixture of sulfurized alkylphenate plus alkylbenzene sulfonate.

By "sulfurized alkylphenate," as used herein, there is understood to mean a solution containing from about 30 to 80 percent by weight, and preferably about 40 to 70 percent by weight, of a sulfurized alkylphenate in a dilution oil which may or may not be the same as that employed to carry out the process of the invention.

Similarly, by "alkylbenzene sulfonate," as used herein, there is understood to mean any solution containing from about 40 to 95 percent by weight, and preferably from about 55 to 85 percent by weight, of an alkylbenzene sulfonate in a dilution oil which may or may not be the same as that used to carry out the process of the invention.

Among the sulfurized alkylphenates which can be employed are those obtained by sulfurization with sulfur of an alkylphenol bearing preferably one or more $C_9$–$C_{15}$ alkyl substituents (such as the nonyl, decyl, dodecyl, or tetradecyl phenols) in the presence of an alkaline earth base and an alkylene glycol, followed possibly by a carbonation with carbon dioxide.

Among the alkylbenzene sulfonates which can be used are the natural sulfonic acid salts (of a molecular weight preferably of more than 400) obtained by sulfonation of petroleum cuts or synthetic salts obtained by sulfonation of alkylbenzenes derived from olefins or polymers of olefins of $C_{15}$–$C_{30}$ and alkaline-earth metals, such as calcium, barium, magnesium, etc.

The alkaline-earth metal compound to be used may consist of oxides or hydroxides of calcium, barium, magnesium, etc., alone or in mixture. The metal from which the alkaline-earth metal alkylbenzene sulfonate and the alkaline earth alkylphenate used are derived may or may not be the same as that or those contained in the alkaline earth metal compound.

Among the dilution oils which can be used, mention may be made preferably of the paraffin oils such as 100 Neutral oil, etc.; the naphthalene or mixed oils may also be suitable.

The amount of dilution oil which can be used is such that the amount of oil present in the final product (including that coming from the sulfurized alkylphenate and the initial alkylbenzene sulfonate) is between about 20 and 60 percent, and preferably between 25 and 55 percent by weight, of said product.

Among the alkylene glycols which can be used is, in particular, ethylene glycol. Other alkylene glycols, such as propylene glycol, may be employed. They can possibly be present in mixture with up to 200 percent of their weight of a monoalcohol such as ethylhexanol, tridecyl alcohol, the $C_8$–$C_{14}$ oxo alcohols, and, in general, alcohols having a boiling point of more than 120° C., and preferably more than 150° C.

A variant of the process of the present invention comprises carrying out the carbonation operation in a single step, in the presence of from 0 to 25 parts, and preferably from 0 to 15 parts, for 100 parts of mixture of sulfurized alkylphenate plus alkylbenzene sulfonate, of a base component or bed material of a TBN greater than or equal to 200 and selected from among;

(a) sulfurized and superalkalinized alkylphenates of alkaline-earth metals, such as calcium, barium, magnesium, etc., the alkyl substituent or substituents of which are $C_9$–$C_{15}$, such as the nonyl, decyl, dodecyl, or tetradecyl substituents;

(b) the superalkalinized alkylbenzene sulfonates of alkaline-earth metals, such as calcium, barium, magnesium, prepared from natural or synthetic sulfonic acids obtained by sulfonation of alkylbenzenes derived from olefins or polymers of olefins of $C_{15}$–$C_{30}$ and a molecular weight of more than 300, and preferably more than 400.

(c) mixtures of products (a) and (b), above.

Another variant of the process of the invention comprises preparing the alkaline-earth metal alkylbenzene sulfonate in situ prior to the carbonation operation by the action of an oxide or hydroxide of the said alkaline-earth metal on an alkylbenzene sulfonic acid, such as defined above, in the presence of dilution oil and alkylene glycol optionally, at a temperature of between about 40° C. and 110° C., the amount of alkaline earth metal oxide or hydroxide and of dilution oil to be used being such that the alkylbenzene sulfonate obtained has a TBN less than or equal to 150 and preferably less than or equal to 50.

The process of the invention is of very particular interest for preparing detergent-dispersant compositions of TBN greater than or equal to 250 and having a large percentage by weight of calcium or barium (at least 9 percent).

The said process can be carried out starting from a sulfurized calcium and/or barium alkylphenate, a calcium and/or barium alkylbenzene sulfonate, and the following quantities of reagents:

(a) from about 5 to 30 parts by weight, and preferably from about 6 to 25 parts by weight, of calcium or barium hydroxide for 100 parts by weight of mixture of sulfurized calcium and/or barium alkylphenate and calcium and/or barium alkylbenzene sulfonate;

(b) from about 4 to 60 parts, and preferably from about 5 to 40 parts, of alkylene glycol for 100 parts of mixture formed of sulfurized calcium and/or barium alkylphenate and calcium and/or barium alkylbenzene sulfonate; and, (c) from about 0 to 25 parts, and preferably from 0 to 15 parts, for 100 parts of a mixture of sulfurized calcium and/or barium alkylphenate and calcium and/or barium alkylbenzene sulfonate of a base component having a TBN of greater than or equal to 250 and formed of a sulfurized and superalkalinized alkylphenate of calcium and/or barium and/or of a superalkalinized alkylbenzene sulfonate of calcium and/or barium.

The process of the invention is also of interest for the preparation of detergent-dispersant compositions of a TBN greater than 200 and containing at least about 2 percent by weight of magnesium and optionally at least about 0.5 percent by weight of calcium.

The process of the present invention comprises using the following among the reaction components:

(a) a sulfurized alkylphenate of magnesium and/or calcium as the sulfurized alkaline-earth metal alkylphenate;

(b) a magnesium and/or calcium alkylbenzene sulfonate as the alkaline-earth metal alkylbenzene sulfonate;

(c) magnesium oxide, possibly mixed with calcium hydroxide, as the alkaline earth compound;

(d) optionally a base component of a TBN greater than or equal to 200, formed of a superalkalinized magnesium and/or calcium alkylbenzene sulfonate and/or a sulfurized and superalkalinized magnesium and/or calcium alkylphenate, and optionally treating the medium at some stage of the carbonation step or steps with 0 to 10 percent by weight, and preferably 0 to 5 percent, by weight of water referred to the weight of the said medium.

The said process can be carried out with the following specific quantities of reagents:

(a) from about 3 to 25 parts, and preferably about 4 to 18 parts, by weight, of magnesium oxide for 100 parts of mixture of sulfurized magnesium and/or calcium alkylphenate and magnesium and/or calcium alkylbenzene sulfonate;

(b) from about 0 to 10 parts, and preferably about 0 to 5 parts, by weight of calcium hydroxide for 100 parts of mixture of sulfurized magnesium and/or calcium alkylphenate and magnesium and/or calcium alkylbenzene sulfonate;

(c) from about 4 to 60 parts, and preferably from about 8 to 40 parts, of alkylene glycol for 100 parts of mixture of sulfurized magnesium and/or calcium alkylphenate and magnesium and/or calcium alkylbenzene sulfonate;

(d) from about 0 to 25 parts, and preferably from about 0 to 15 parts of base component for 100 parts of mixture of sulfurized magnesium and/or calcium alkylphenate and magnesium and/or calcium alkylbenzene sulfonate.

Although any type of magnesium oxide can be used, "active" magnesium oxide is, however, preferred. By "active magnesium oxide" is intended magnesium oxide (MgO) of a specific surface greater than or equal to about 80 $m^2/g$, for instance, between about 100 and 170 $m^2/g$. By way of example, mention may be made of the "Maglite DE" marketed by Merck of a specific surface of approximately 140 $m^2/g$, as well as the "Ferumag" marketed by Rhone-Poulenc Industries of a specific surface close to 160 $m^2/g$.

Another object of the present invention is the detergent-dispersant compositions of high alkalinity obtained by the process of the invention. They have the advantage of excellent compatibility with viscous oils, as well as a very low content of sediment. They can be added to lubricating oils in quantities which are a function of the TBN of the said detergent-dispersants and a function of the future use of the said oils. Thus, for a gasoline engine oil, the amount of detergent-dispersant of a TBN of 200–300, for example, to be added is generally between about 1 and 3.5 percent. For a diesel engine oil, it is generally between about 1.8 and 5 percent. For a marine engine oil, it may go up to about 25 percent. All quantities are by weight.

The lubricating oils which can thus be improved can be selected from among a very large number of lubricating oils, such as the naphthene-base, paraffin-base, and mixed-base lubricating oils, other hydrocarbon lubricants, for instance, lubricating oils, derived from coal products, and synthetic oils, for instance, alkylene polymers, polymers of the alkylene-oxide type and their derivatives, including the alkylene-oxide polymers prepared by polymerizing alkylene oxide in the presence of water or alcohols, for instance, ethyl alcohol, dicarboxylic acid esters, liquid esters of phosphorus acids, alkylbenzenes and dialkylbenzenes, polyphenyls, alkyl biphenyl ethers and polymers of silicon.

Additional additives can also be present in the said lubricating oils in addition to the detergent-dispersant compositions of the invention. For example, mention may be made of antioxidants, anticorrosion additives, ashless dispersing additives, etc.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLES 1 TO 3

The general method of preparation of the superalkalinized detergent-dispersant of these examples forming the object of Examples 1 to 3 is indicated below and the amounts of reagents necessary for their preparation and their characteristics are set forth in Table I, below.

Preparation of the mixture to be carbonated:

Into a 4-liter, four-neck reactor provided with an agitation system and a heating device there are introduced:

(a) a 60 percent solution in 100 Neutral dilution oil of a sulfurized calcium alkylphenate (Ca phenate) obtained by sulfurization of dodecyl phenol (DDT) by sulfur in the presence of lime; the said phenate solution, containing 5.5 percent calcium, is free of $CO_2$, and has a TBN of about 153;

(b) 100 Neutral oil;

(c) a solution of about 60 percent in dilution oil of a calcium alkylbenzene sulfonate (Ca sulfonate) of a molecular weight of about 470 (weight of the sodium salt), the solution containing 2.7 percent calcium and having a TBN of about 25;

(d) a methylpolysiloxane antifoam agent, marketed by Rhone-Poulenc Industries, under the designation "SI 200."

Lime and glycol are then introduced with agitation and the medium is brought to and maintained at a temperature of 145° C., at 260 mm. of mercury pressure, for 20 minutes, in order to completely remove the water produced from the reaction of the lime. The water eliminated always carries with it a small amount of the glycol.

1st phase (carbonation):

After the amount of glycol has been readjusted to its original value, the reaction medium is carbonated at 145° C., with $CO_2$ for 25 minutes at 260 mm. mercury pressure, and then for 35 minutes at atmospheric pressure. Water is eliminated, entraining with it a small amount of glycol.

2nd phase (elimination of the glycol):

The superalkalinized carbonated medium is brought to a temperature of 184° C., at 30 mm. mercury pressure for one hour. The glycol distills off.

3rd phase (separation):

The medium is filtered to eliminate the sediments and there is obtained a solution in 100 N oil of superalkalinized detergent-dispersant which is degasified and the characteristics of which are set forth in Table I, below.

TABLE I

| Example No. | 1 | 2 | 3 |
|---|---|---|---|
| Ca phenate in g. | 726 | 544 | 363 |
| Ca sulfonate in g. | 929 | 1073 | 1216 |
| Phenate/sulfonate | 44/56 | 34/66 | 23/77 |
| Oil in g. | 0 | 0 | 13 |
| SI 200 in cc. | 1 | 1 | 1 |
| lime in g. | 298 | 315 | 334 |
| glycol in g. | 300 | 150 | 160 |
| 1st phase | | | |
| $CO_2$ in g. | 185 | 190 | 198 |
| weight of distillate collected (water + glycol) in g. | 104 | 102 | 106 |
| 2nd and 3rd phases | | | |
| glycol distilled in g. | 280 | 130 | 135 |
| % sediment | 0.8 | 0.8 | 0.8 |
| weight of solution of detergent-dispersant in g. | 1989 | 1992 | 1994 |
| Analysis of the solution | | | |
| % Ca | 10.7 | 11.0 | 10.8 |
| TBN | 269 | 272 | 270 |
| Appearance | bright | bright | slightly cloudy |
| Compatibility of 10% in a mineral oil (appearance of the solution) | clear | clear | slightly cloudy |
| % sediment | 0.06 | 0.07 | 0.15 |
| Quantity DDP to make 100 g. of finished product | 16 | 12 | 8 |

EXAMPLES 4 TO 6

The operation described in Examples 1 to 3 is carried out under the same conditions starting from a 60 percent solution in 100 N oil of a sulfurized dodecyl phenate (DDP) and calcium carbonate, the said solution containing 5.25 percent of calcium and 2.6 percent of $CO_2$ and having a TBN of about 148.

The amounts of reagents necessary and the characteristics of the products obtained are set forth in Table II, below.

TABLE II

| Example No. | 4 | 5 | 6 |
|---|---|---|---|
| Ca phenate in g. | 852 | 638 | 426 |
| Ca sulfonate in g. | 929 | 1073 | 1216 |
| Phenate/sulfonate | 48/52 | 37/63 | 26/74 |
| Oil in g. | 0 | 0 | 0 |
| SI 200 in cc. | 1 | 1 | 1 |
| lime in g. | 286 | 308 | 327 |
| glycol in g. | 300 | 150 | 160 |
| 1st phase | | | |
| $CO_2$ in g. | 150 | 173 | 180 |
| weight of distillate collected (water + glycol) in g. | 103 | 102 | 104 |
| 2nd and 3rd phases | | | |
| glycol distilled in g. | 290 | 130 | 140 |
| % sediment | 0.8 | 0.8 | 0.8 |
| weight of solution of detergent-dispersant in g. | 1950 | 1920 | 1800 |
| Analysis of the solution | | | |
| % Ca | 10.9 | 11.2 | 11.0 |
| TBN | 271 | 273 | 272 |
| Appearance | bright | bright | slightly cloudy |
| Compatibility of 10% in a mineral oil (appearance of the solution | clear | clear | slightly cloudy |
| % sediment | 0.06 | 0.08 | 0.12 |
| Quantity DDP to make 100 g. of finished product | 19 | 14 | 9.5 |

EXAMPLE 7

The general method of preparation of a superalkalinized detergent-dispersant is set forth below and the amounts of reagents necessary for its preparation and its characteristics are given in Table III, below.

Into a 4-liter, four-neck reactor provided with an agitator system and a heating device there are introduced:

(a) a 60 percent solution in 100 Neutral dilution oil, of a sulfurized calcium alkylphenate (Ca phenate) obtained by sulfurization of dodecyl phenol (DDP) with sulfur in the presence of lime; the said phenate solution, containing 5.5 percent calcium, is free of $CO_2$, and has a TBN of about 153;

(b) an approximately 60 percent solution in dilution oil of a magnesium alkylbenzene sulfonate (Mg sulfonate) of a molecular weight of about 470 (weight of the sodium salt), the solution containing 1.8 percent of magnesium and having a TBN of about 25; and (c) antifoam SI 200.

"Maglite DE" and glycol are then introduced with agitation and the medium is brought to 110° C.

It is carbonated with $CO_2$ for 3 hours at 110° C., water is added, and the carbonation is continued until the end of the absorption of the $CO_2$. The operation takes 5 hours.

The glycol is eliminated (second phase) and the detergent-dispersant solution is filtered (third phase) as previously in Examples 1 to 3.

The characteristics of the product obtained appear in Table III, below.

TABLE III

| Example No. | 7 |
|---|---|
| Phenate in g. | 870 |
| Sulfonate Mg in g. | 990 |
| Phenate/sulfonate | 47/53 |
| Oil in g. | 0 |
| SI 200 in cc. | 1 |
| MgO in g. | 110 |
| glycol in g. | 220 |
| 1st phase | |
| $CO_2$ in g. | 110 |
| water | 50 |
| weight of distillate collected in g. | 100 |
| 2nd and 3rd phases | |
| glycol distilled in g. | 130 |
| % sediment | 1.5 |
| weight of solution of detergent-dispersant in g. | 2000 |
| Analysis of the solution | |
| % Mg | 2.9 |
| % Ca | 2.8 |
| TBN | 200 |
| Appearance | bright |
| Compatibility of 10% in a mineral oil (appearance of the solution) | clear |
| % sediment | 0.02 |
| Quantity DDP to make 100 g. of finished product | 19.1 |

EXAMPLE 8

The operation described in Example 7 is carried out in the presence of a base component of a TBN of 200 prepared in Example 7, formed of a 44:56 mixture of sulfurized calcium dodecyl phenate and magnesium alkylbenzene sulfonate.

The amounts of reagents used and the characteristics of the products obtained are set forth in Tables IV and IV(a) below.

EXAMPLE 9

The operation described in Example 7 is carried out in the presence of a base component of TBN 275, formed of:

(a) 50 percent by weight of sulfurized calcium dodecyl phenate of a TBN of 150; and (b) 50 percent of weight of magnesium alkylbenzene sulfonate of a TBN of 400.

The glycol is also used in mixture with decanol.

The amounts of reagents used and the characteristics of the product obtained are set forth in Tables IV and IV(a), below.

TABLE IV

| Example No. | 8 | 9 |
|---|---|---|
| Ca phenate in g. | 720 | 100 |
| Mg sulfonate in g. | 606 | 929 |
| Phenate/sulfonate | 54/46 | 10/90 |
| Oil in g. | 0 | 278 |
| SI 200 in cc. | 1 | 1 |
| Base component in g. | 180 | 140 |
| TBN | 200 | 275 |
| Phenate/sulfonate | 44/56 | 50/50 |
| MgO | 118 | 120 |
| Glycol | 314 | 200 |
| Decanol | 0 | 50 |

TABLE IV-continued

| Example No. | 8 | 9 |
|---|---|---|
| $CO_2$ in g. | 120 | 188 |
| water in g. | 60 | 40 |
| weight of distillate collected in g. | 130 | 100 |

TABLE IV(a)

| Example No. | 8 | 9 |
|---|---|---|
| 2nd and 3rd phases | | |
| glycol distilled in g. | 204 | 130 |
| % sediment | 1.5 | 3 |
| weight of solution of detergent-dispersant in g. | 2180 | 1700 |
| Analysis of the solution | | |
| % Mg | 3.6 | 5.3 |
| % Ca | 2.1 | 0.3 |
| TBN | 210 | 230 |
| Appearance | bright | bright |
| Compatibility at 10% in a mineral oil (appearance of the solution) | clear | clear |
| % sediment | 0.06 | 0.08 |
| Quantity DDP to make 100 g. of finished product | 16 | 3 |

EXAMPLE 10

The operation described in Example 7 is carried out by effecting the carbonation operation at 140° C., at atmospheric pressure for about 4 hours, without addition of water.

The characteristics of the product obtained are similar to those of the product of Example 7.

EXAMPLE 11

The operation described in Example 7 is carried out by effecting the carbonation operation for 2 hours at 160° C., adding water after having cooled the medium to 110° C., and continuing the carbonation for a further 2 hours at 110° C.

The characteristics of the product obtained are similar to those of the product of Example 7.

EXAMPLES 12 TO 14

The general method of preparing the superalkalinized detergent-dispersant composition of Examples 12 to 14 is indicated below and the quantities of reagents necessary for their preparation are set forth in Table V, below.

Into a 4-liter, four-neck reactor provided with an agitation system and a heating device there are introduced: an approximately 70 percent solution in dilution oil of an alkylbenzene sulfonic acid of a molecular weight of about 470 (weight of the sodium salt), 100 N oil, and antifoam SI 200.

The medium is heated to about 50° C. and the lime and then the glycol are introduced within the course of 30 minutes.

The medium is heated at 80° C. for 30 minutes and a 60 percent solution in 100 N dilution oil of sulfurized calcium dodecyl phenate is introduced, the said solution containing 5.5 percent calcium, being free of $CO_2$, and having a TBN of about 153.

The medium is brought to and maintained at 145° C. at 260 mm. mercury pressure for 20 minutes in order completely to eliminate the water of reaction. The water eliminated always entrains a small amount of glycol with it.

1st carbonation phase

The medium is carbonated at 145° C. with $CO_2$ for 25 minutes at 260 mm. mercury pressure and then for 35 minutes at atmospheric pressure.

2nd carbonation phase

Lime and glycol are again introduced with agitation. The medium is brought to and held at 145° C. at 260 mm. mercury pressure for 20 minutes in order to eliminate the water of reaction.

Carbonation is effected at 145° C. with $CO_2$ for 25 minutes at 260 mm. mercury pressure and then for 35 minutes at atmospheric pressure. Water is eliminated, entraining a small amount of glycol with it.

The glycol is eliminated (third phase) and the detergent-dispersant solution is filtered (fourth phase) as previously in Examples 1 to 3.

The amounts of reagents used and the characteristics of the products obtained are set forth in Tables V and V(a), below.

TABLE V

| Example No. | 12 | 13 | 14 |
|---|---|---|---|
| Ca phenate in g. | 726 | 544 | 363 |
| sulfonic acid in g. | 568 | 656 | 744 |
| phenate/sulfonic acid | 56/44 | 45/55 | 33/67 |
| oil in g. | 309 | 383 | 456 |
| SI 200 in cc. | 0.2 | 0.2 | 0.2 |
| lime in g. | 200 | 223 | 251 |
| glycol in g. | 200 | 223 | 251 |
| 1st carbonation phase | | | |
| $CO_2$ in g. | 120 | 125 | 120 |
| weight of distillate collected (glycol + water) | 100 | 102 | 100 |
| % sediment | 0.3 | 0.3 | 0.4 |
| 2nd carbonation phase | | | |
| lime in g. | 140 | 140 | 140 |
| glycol in g. | 280 | 280 | 280 |
| $CO_2$ in g. | 83 | 83 | 83 |
| weight of distillate collected (water + glycol) in g. | 40 | 40 | 40 |

TABLE V(a)

| Example | 12 | 13 | 14 |
|---|---|---|---|
| 3rd and 4th phases | | | |
| glycol distilled in g. | 280 | 290 | 310 |
| % sediment | 0.8 | 1 | 1.2 |
| weight of solution of detergent-dispersant in g. | 2022 | 2016 | 2014 |
| Analysis of the solution | | | |
| % Ca | 10.7 | 11.0 | 10.8 |
| TBN | 269 | 272 | 270 |
| Appearance | bright | bright | slightly cloudy |
| Compatibility at 10% in a mineral oil (appearance of the solution) | clear | clear | slightly cloudy |
| % sediment | 0.06 | 0.08 | 0.12 |
| Amount to DDP to make up 100 g. of finished product | 16 | 11 | 18 |

Sediment Content

The percentages of sediments appearing in the foregoing tables were measured in accordance with ASTM Standard D 2273-67, making, however, the following changes:

speed of rotation of the centrifuge, 6000 r.p.m.;

relative centrifugal force, 10,000;

the product to be analyzed is diluted to one-quarter in E gasoline (25 cc. of product to be analyzed plus 75 cc. of E gasoline);

time of centrifuging, 10 minutes.

Compatibility

The compatibility tests appearing in the foregoing tables were carried out by adding 10 percent by weight of product to be tested to an SAE 30 mineral oil, storing the resultant solution for one month at 20° C., and studying the appearance of the solution as a function of time.

Comparison with Commercial Products

Test with the additive alone:

The product of Example 12 is added to an SAE 30 oil of paraffinic nature so as to obtain a solution containing 125 millimols of calcium plus magnesium. The solution is stored for 15 days at 20° C. It is noted that the solution remains clear. The same test is carried out with a mixture of:

magnesium alkylbenzene sulfonate of TBN 400;

calcium alkylbenzene sulfonate of TBN 25;

calcium alkylphenate of TBN 150;

in such amount that the solution obtained contains 125 millimols of calcium and magnesium.

After storage for 15 days at 20° C., the solution is cloudy and flocculant.

Test with the additive in formulation:

A mixture (A) is prepared of additives containing:

2 percent of a dispersant having a base of polyisobutenyl succinimide;

1.6 millimols of a zinc dithiophosphate; and 2.3 percent of product of Example 12.

This mixture is kept for 25 days at 80° C. and is then added to an SAE 30 oil so as to have a concentration of 6.6 percent by weight of mixture (A).

The solution is stored for 5 days at 80° C.

The same test is carried out with a mixture (B) formed of:

2 percent dispersant having a base of polyisobutenyl succinimide;

1.6 millimols of zinc dithiophosphate; and 2.3 percent of a mixture formed of:

magnesium alkylbenzene sulfonate of TBN 400;

calcium alkylbenzene sulfonate of TBN 25;

calcium alkylphenate of TBN 150;

having a number of millimols of calcium and magnesium equivalent to that of the product of Example 12.

It is noted that the solution containing mixture (A) is lighter and brighter than that containing mixture (B).

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process of preparing a detergent-dispersant composition from an alkaline-earth metal alkylbenzene sulfonate, a sulfurized alkylphenate of an alkaline-earth metal, an alkaline-earth metal compound, an alkylene glycol, and carbon dioxide comprising the steps of:

(1) carbonating, with carbon dioxide, at a temperature of between about 100° C. and 250° C., a reaction medium which comprises:

(a) a sulfurized alkylphenate of an alkaline-earth metal of a TBN of between 0 and 170, the said alkylphenate bearing one or more $C_6$–$C_{60}$ alkyl substituents;

(b) an alkaline-earth metal alkylbenzene sulfonate of a molecular weight of more than 300 and a TBN of less than or equal to 150;

(c) an alkaline-earth metal compound; and (d) an alkylene glycol;

in a dilution oil in accordance with the following quantities of reagents:

(a) from about 5 to 60 parts by weight of sulfurized alkylphenate for 100 parts by weight of mixture of sulfurized alkylphenate plus alkylbenzene sulfonate;

(b) from about 40 to 95 parts by weight of alkylbenzene sulfonate for 100 parts by weight of mixture of sulfurized alkylphenate plus alkylbenzene sulfonate;

(c) from about 3 to 30 parts by weight of alkaline-earth metal compound for 100 parts by weight of a mixture of sulfurized alkylphenate plus alkylbenzene sulfonate;

(d) from 4 to 60 parts by weight of alkylene glycol for 100 parts by weight of mixture of sulfurized alkylphenate plus alkylbenzene sulfonate; and (e) the amount of carbon dioxide necessary for the carbonation being between that which can be completely absorbed by the reaction medium and an excess of 30 percent of said amount;

(2) removing the alkylene glycol; and (3) separating the superalkalinized metallic detergent-dispersant composition thus obtained.

2. A process according to claim 1, wherein the carbonation operation is carried out at least one time, introducing the amount defined in claim 1 of alkaline-earth compound and alkylene glycol at least one time, each introduction of alkaline-earth compound and alkylene glycol being followed by a carbonation operation.

3. A process according to claim 2, wherein the carbonation operation is carried out at a temperature of between about 100° C. and 185° C., in the presence of a reaction mixture comprising:

(a) from about 8 to 55 parts by weight of sulfurized alkylphenate for 100 parts by weight of mixture of sulfurized alkylphenate plus alkylbenzene sulfonate;

(b) from about 45 to 92 parts by weight of alkylbenzene sulfonate for 100 parts by weight of mixture of sulfurized alkylphenate plus alkylbenzene sulfonate;

(c) from about 4 to 25 parts by weight of alkaline-earth compound for 100 parts by weight of mixture of sulfurized alkylphenate plus alkylbenzene sulfonate;

(d) from about 5 to 40 parts by weight of alkylene glycol for 100 parts by weight of mixture of sulfurized alkylphenate plus alkylbenzene sulfonate;

(e) the amount of carbon dioxide necessary being substantially equal to that which can be completely absorbed.

4. A process according to claim 1 or claim 3, wherein the sulfurized alkylphenate is selected from among those obtained by sulfurization with sulfur of an alkylphenol bearing at least one $C_9$–$C_{15}$ alkyl substituent in the presence of an alkaline-earth metal base derived from metals selected from the class consisting of calcium, barium, and magnesium, with an alkylene glycol.

5. A process according to claim 4 wherein the sulfurized alkylphenate is carbonated with carbon dioxide.

6. A process according to claim 1 or claim 3, wherein the alkylbenzene sulfonate is selected from among sulfonic acid salts of a molecular weight of more than 400, either natural, obtained by sulfonation of petroleum cuts, or synthetic, obtained by sulfonation of alkylbenzene obtained from olefins or polymers of olefins of $C_{15}$–$C_{30}$ and alkaline-earth metals selected from calcium, barium, and magnesium.

7. A process according to claim 1 or claim 2, wherein the alkaline-earth compound is formed of a member selected from the class consisting of oxides and hydroxides of calcium, barium, and magnesium, and their mixtures.

8. A process according to claim 1 or claim 2, wherein the alkylene glycol is ethylene glycol.

9. A process according to one of claims 1 or 2, wherein the alkylene glycol is present in mixture with up to about 200 percent of its weight of a monoalcohol having a boiling point of more than 120° C.

10. A process according to one of claims 1 or 2, wherein the carbonation operation is carried out in a single step in the presence of from 0 to about 25 parts for 100 parts of mixture of sulfurized alkylphenate plus alkylbenzene sulfonate, of a bed material of TBN greater than or equal to 200 and selected from among:

(a) sulfurized superalkalinized alkylphenates of an alkaline-earth metal selected from calcium, barium, and magnesium, the alkyl substituent or substituents of which are of $C_9$–$C_{15}$;

(b) superalkalinized alkylbenzene-sulfonates of alkaline-earth metals selected from calcium, barium, and magnesium, prepared form natural or synthetic sulfonic acids obtained by sulfonation of alkylbenzenes derived from olefins or polymers of olefins of $C_{15}$–$C_{30}$ and of a molecular weight of more than 300; and (c) the mixtures of products (a) and (b).

11. A process according to claim 10, wherein the carbonation operation is carried out in the presence of 0 to 15 parts of the said bed material for 100 parts of mixture of sulfurized alkylphenate plus alkylbenzene sulfonate.

12. A process according to claim 1, wherein the carbonation operation is carried out on a mixture whose alkaline-earth metal component has a base of calcium or barium, in accordance with the following proportions of the said components and alkylene glycol:

(a) from about 5 to 60 parts by weight of sulfurized calcium and/or barium alkylphenate for 100 parts by weight of mixture of sulfurized calcium and/or barium alkylphenate plus calcium and/or barium alkylbenzene sulfonate;

(b) from about 40 to 95 parts by weight of calcium and/or barium alkylbenzene sulfonate for 100 parts by weight of mixture of calcium and/or barium alkylphenate plus calcium and/or barium alkylbenzene sulfonate;

(c) from about 5 to 30 parts by weight of calcium or barium hydroxide for 100 parts by weight of mixture of sulfurized calcium and/or barium alkylphenate plus calcium and/or barium alkylbenzene sulfonate;

(d) from about 4 to 60 parts of alkylene glycol for 100 parts of mixture of sulfurized calcium and/or barium alkylphenate plus calcium and/or barium alkylbenzene sulfonate; and (e) from about 0 to about 25 parts for 100 parts of mixture of sulfurized calcium and/or barium alkylphenate plus calcium and/or barium alkylbenzene sulfonate, of a bed material of TBN greater than or equal to 250 and formed of a sulfurized superalkalinized alkylphenate or calcium and/or barium and/or a superalkalinized alkylbenzene sulfonate of calcium and/or barium.

13. A process according to claim 12, wherein the components having a base of calcium or barium and the alkylene glycol are used in accordance with the following proportions:

(a) from about 8 to 55 parts by weight of sulfurized calcium and/or barium alkylphenate for 100 parts by weight of mixture of sulfurized calcium and/or barium alkylphenate plus calcium and/or barium alkylbenzene sulfonate;

(b) from about 45 to 92 parts by weight of calcium and/or barium alkylbenzene sulfonate for 100 parts by weight of mixture of sulfurized calcium and/or barium alkylphenate plus calcium and/or barium alkylbenzene sulfonate;

(c) from about 6 to 25 parts by weight of calcium or barium hydroxide for 100 parts by weight of mixture of sulfurized calcium and/or barium alkylphenate plus calcium and/or barium alkylbenzene sulfonate;

(d) from about 5 to 40 parts of alkylene glycol for 100 parts of mixture of sulfurized calcium and/or barium alkylphenate plus calcium and/or barium alkylbenzene sulfonate; and (e) from 0 to about 15 parts for 100 parts of mixture of sulfurized calcium and/or barium alkylphenate plus calcium and/or barium alkylbenzene sulfonate, of the said bed material of TBN greater than or equal to 250.

14. A process according to claim 1 wherein the carbonation operation is carried out on a mixture whose alkaline-earth components have a base of magnesium and/or calcium in accordance with the following proportions of the said components and alkylene glycol:

(a) from about 5 to 60 parts by weight of magnesium and/or calcium sulfurized alkylphenate for 100 parts by weight of mixture of sulfurized magnesium and/or calcium alkylphenate;

(b) from about 95 to 40 parts by weight of magnesium and/or calcium alkylbenzene sulfonate for 100 parts by weight of mixture of sulfurized magnesium and/or calcium alkylphenate plus magnesium and/or calcium alkylbenzene sulfonate;

(c) from about 3 to 25 parts by weight of magnesium oxide for 100 parts of mixture of sulfurized magnesium and/or calcium alkylphenate plus magnesium and/or calcium alkylbenzene sulfonate;

(d) from 0 to about 10 parts by weight of calcium hydroxide for 100 parts of mixture of sulfurized magnesium and/or calcium alkylphenate plus magnesium and/or calcium alkylbenzene sulfonate;

(e) from about 4 to 60 parts of alkylene glycol for 100 parts of mixture of sulfurized magnesium and/or calcium alkylphenate plus magnesium and/or calcium alkylbenzene sulfonate;

(f) from 0 to about 25 parts for 100 parts of mixture of sulfurized magnesium and/or calcium alkylphenate plus magnesium and/or calcium alkylbenzene sulfonate, of a bed material of TBN greater than or equal to 200, formed of a superalkalinized magnesium and/or calcium alkylbenzene sulfonate and of a sulfurized and superalkalinized magnesium and/or calcium alkylphenate, and by treating the medium at any stage of the carbonation step or steps with 0 to 10 percent by weight of water referred to the weight of the said reaction medium.

15. A process according to claim 14, wherein the components having a base of magnesium and/or calcium, the alkylene glycol and the water are used in accordance with the following proportions:

(a) from about 8 to 55 parts by weight of sulfurized magnesium and/or calcium alkylphenate for 100 parts by weight of mixture of sulfurized magnesium and/or calcium alkylphenate plus magnesium and/or calcium alkylbenzene sulfonate;

(b) from about 45 to 92 parts by weight of magnesium and/or calcium alkylbenzene sulfonate for 100 parts by weight of mixture of sulfurized magnesium and/or calcium alkylphenate plus magnesium and/or calcium alkylbenzene sulfonate;

(c) from about 4 to 18 parts by weight of magnesium oxide for 100 parts by weight of mixture of sulfurized magnesium and/or calcium alkylphenate plus magnesium and/or calcium alkylbenzene sulfonate;

(d) from 0 to about 5 parts by weight of calcium hydroxide for 100 parts of mixture of sulfurized magnesium and/or calcium alkylphenate plus magnesium and/or calcium alkylbenzene sulfonate;

(e) from about 8 to 40 parts of alkylene glycol for 100 parts of mixture of sulfurized magnesium and/or calcium alkylphenate plus magnesium and/or calcium alkylbenzene sulfonate;

(f) from 0 to about 15 parts of said bed material of a TBN greater than or equal to 200 for 100 parts of mixture of sulfurized magnesium and/or calcium alkylphenate plus magnesium and/or calcium alkylbenzene sulfonate;

(g) from 0 to about 5 percent by weight of water referred to the weight of the reaction mixture.

16. A detergent-dispersant additive for lubricating oils, obtained by the process defined by claim 1.

17. A novel lubricating composition, having desirable detergent and dispersion properties, comprising an oil containing up to about 25 percent by weight of a novel lubricant additive composition according to claim 16.

18. A gasoline engine oil, having desirable detergent and dispersion properties, containing between about 1 and 3.5 percent by weight of a novel lubricant additive composition according to claim 16.

19. A novel diesel engine oil having desirable detergent and dispersion properties containing between about 1.8 and 5 percent by weight of a novel lubricant additive composition according to claim 16.

20. A process according to claim 7, wherein the alkylene glycol is present in mixture with up to about 200 percent of its weight of a monoalcohol having a boiling point of more than 120° C.

* * * * *

UNITED STATES PATENT AND TRADEMARK OFFICE

CERTIFICATE OF CORRECTION

PATENT NO. : 4,412,927

DATED : November 1, 1983

INVENTOR(S) : Bernard Demoures et al.

It is certified that error appears in the above-identified patent and that said Letters Patent is hereby corrected as shown below:

Column 6, line 1, "DDT" should be -- DDP --.

Column 9, line 4, "188" should be -- 118 --.

Signed and Sealed this

*Fifth* Day of *March 1985*

[SEAL]

*Attest:*

DONALD J. QUIGG

*Attesting Officer* *Acting Commissioner of Patents and Trademarks*